United States Patent [19]

Gentry

[11] 3,995,577

[45] Dec. 7, 1976

[54] MARINE DEVICE RETRIEVING APPARATUS

[76] Inventor: Hermond G. Gentry, 2799 Redding Road NW., Atlanta, Ga. 30319

[22] Filed: Jan. 16, 1976

[21] Appl. No.: 649,855

[52] U.S. Cl. ..... 114/206 R; 294/66 R

[51] Int. Cl.[2] ..... B63B 21/22

[58] Field of Search ..... 114/206 R, 210, 221 R, 114/208; 294/66 R; 43/17.2, 44.97

[56] References Cited

UNITED STATES PATENTS

| | | | |
|---|---|---|---|
| 2,760,810 | 8/1956 | Smith | 294/66 R |
| 3,094,095 | 6/1963 | Litchfield et al. | 114/210 |
| 3,735,520 | 5/1973 | Jarrett | 43/17.2 |
| 3,809,001 | 5/1974 | Shute | 114/206 R |

*Primary Examiner*—Trygve M. Blix
*Assistant Examiner*—Stuart M. Goldstein
*Attorney, Agent, or Firm*—Walter M. Rodgers; Walter A. Rodgers

[57] ABSTRACT

Apparatus and method for retrieving an ensnared marine device having an elongated shank, the shank having a crown end and a ring end, a primary line attached to the ring end and secured to the boat, a release element slidably mounted on the primary line adjacent the shank, a release line interconnecting the release element and the crown end, a coupling element slidable along the primary line for engaging the release element and comprising a guiding cavity for controlling the attitude of the coupling element during the sliding movement along the primary line and a coupling cavity, the coupling cavity comprising an entry portion and a locking portion, and a lifting line connected to the coupling element.

9 Claims, 7 Drawing Figures

MARINE DEVICE RETRIEVING APPARATUS

In order for a conventional boat anchor to perform an adequate boat anchoring function, the flukes of the anchor must dig into the earth. Frequently such operations result in an entanglement of one or more of the flukes with roots, rocks, debris, underwater cables, pipe lines and the like making it impossible to release the anchor by conventional methods. In order to render an anchor releasable several methods have been employed in the past but each has undesirable features that greatly limit their effectiveness. One method employs an extra line with one end secured to the crown of the anchor and the other end attached to a float. The anchor is released by picking up the float and pulling in the anchor by the float line. This requires that the float be attached and picked up each time the boat is anchored. This extra effort generally discourages the use of this method, especially since it cannot be used in crowded conditions due to space limitations and the danger of the float being destroyed by boats in the area. It has also been the practice to latch the flukes by a yieldable latch which is unlatched by an excessive tension on the anchor line. While such yieldable latches may render the anchor releasable from undesired entanglement, it is likely that undesired release of the anchor may occur when the pulling force on the anchor line exceeds the bias of the yieldable latch. Another system employs a ring secured to the anchor line and slidably mounted on the anchor shank. This arrangement may result in undesired release of the anchor due to a change in the direction of wind or tide which causes the ring to slide to the crown of the anchor. Still another system utilizes an element slidable along the anchor line and having a plurality of claws secured thereto. These claws are biased inwardly and are adapted to engage a second element slidably mounted on the anchor line. This allows a force to be applied to the crown end of the anchor by which release of an ensnared anchor is effected. Since there is a practical limit to the bias force which may be applied to the claws in this system, it is not well suited to providing the release of very large anchors. In addition the claws must slide over chain links, clevises, pins, and the like.

According to this invention, a marine device releasing force is imparted to a part of the marine device near the crown thereof by means of a release element slidably mounted on the primary line adjacent the shank, a release line interconnecting the release element and a part of the marine device at the opposite end of the shank, a coupling element slidable along the primary line for engaging the release element and comprising a guiding cavity for controlling the attitude of the coupling element during the sliding movement along the primary line and a coupling cavity, the coupling cavity comprising an entry portion for initially receiving a portion of the release element and a locking portion for preventing release of a coupled relation between the release element and the coupling element, and a lifting line connected to the coupling element.

For a better understanding of the invention reference may be had to the following detailed description taken in conjunction with the accompanying drawings in which FIG. 1 represents a boat and its associated anchor and anchor line depicted with the anchor entangled;

Figure 6:
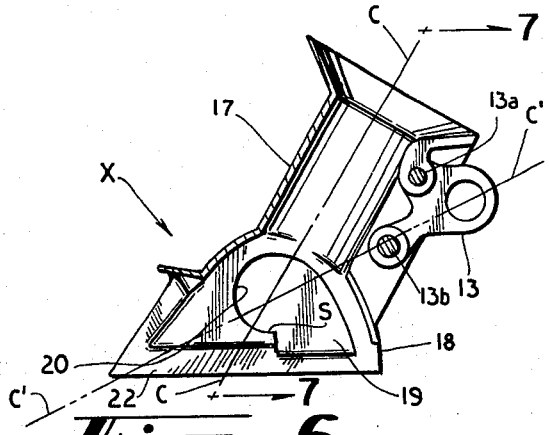
FIG. 6 is an enlarged sectional view of the coupling element taken along the line 6—6 in FIG. 4.
Figure 7:
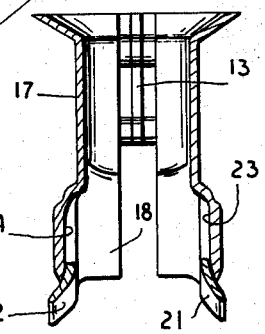
Figure 5:
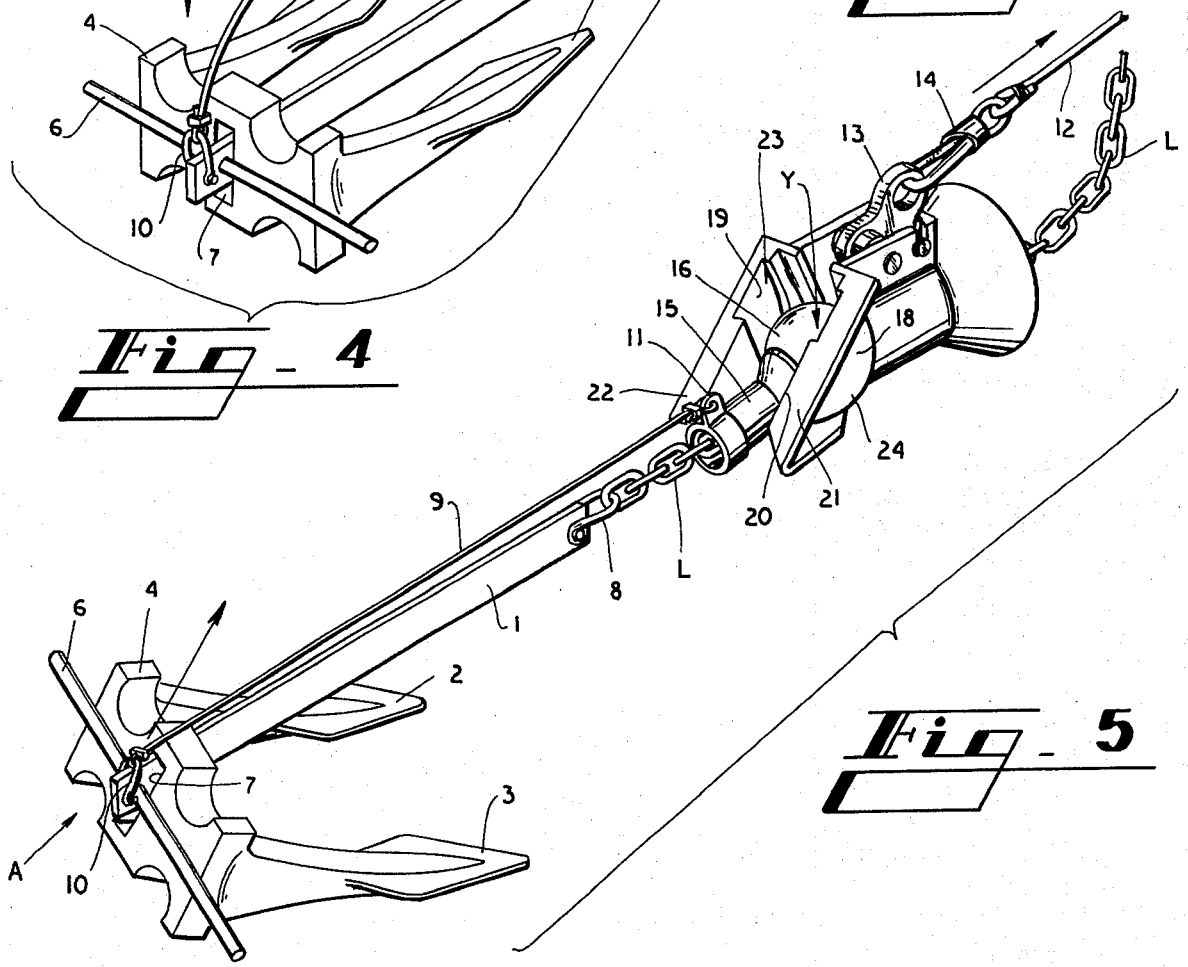
FIG. 5 is a view similar to FIG. 4 but showing the anchor and the associated coupling apparatus after the coupled relation has been effected.

and in which FIG. 7 is an enlarged sectional view of the coupling element taken along line 7—7 in FIG. 6.

Figure 1:
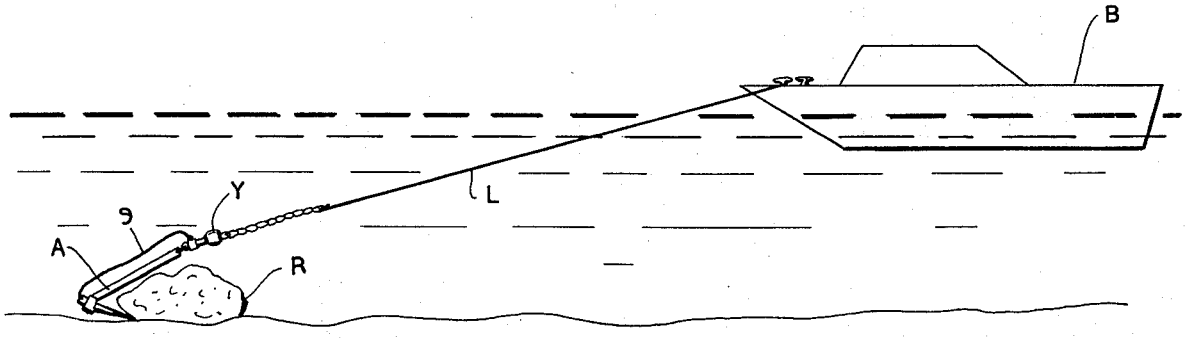
Figure 2:
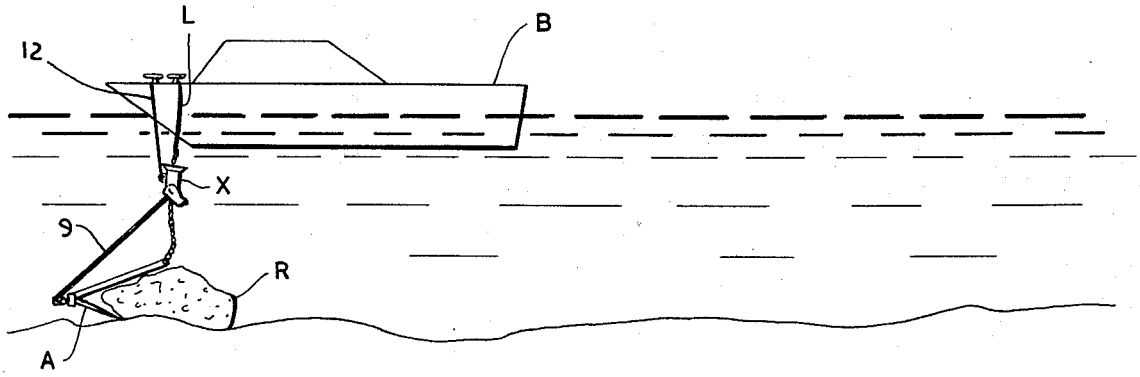
FIG. 2 is a view similar to FIG. 1 but showing the anchor in the process of disengaging the rock ensnarement.

With reference particularly to FIGS. 1 and 2, the letter B represents a boat with its anchor A ensnared by an obstruction such as rock R. Anchor A is interconnected with boat B by primary line L.

Figure 3:
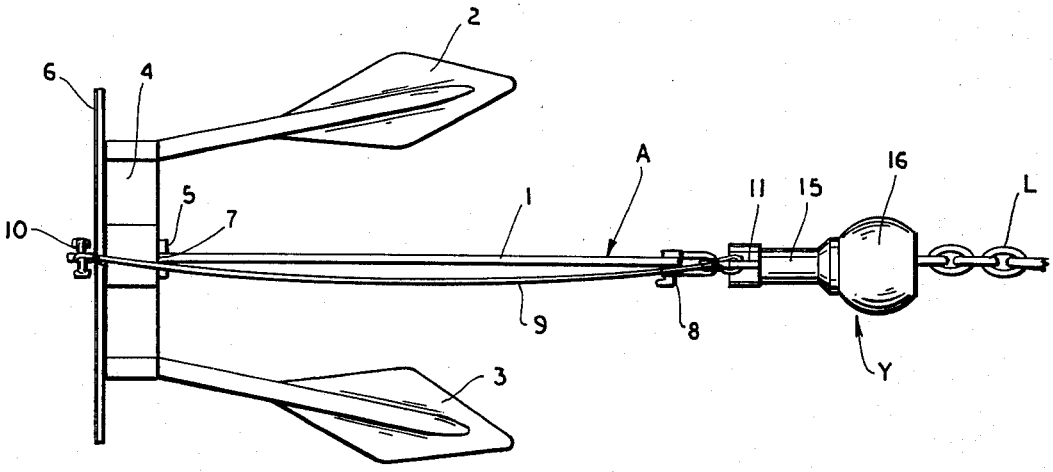
FIG. 3 is an enlarged plan view of the anchor depicted in FIGS. 1 and 2.

With reference to FIG. 3, anchor A comprises a shank designated by the numeral 1 together with flukes 2 and 3. Flukes 2 and 3 are secured to base 4. Base 4 is slidably mounted on shank 1 between pin 5 and rod 6 by means of slot 7 thereby allowing flukes 2 and 3 to pivot whenever the anchor A is deployed. Primary line L is secured to anchor A by means of ring 8. Of course the normal boat holding operation is effected when the flukes 2 and 3 dig into the earth and when the primary line L is disposed in a relatively small angle to horizontal as shown in FIG. 1.

When the anchor flukes 2 and 3 become ensnared with a rock or other object as depicted in FIG. 1 by the letter R, the anchor is released according to this invention by first moving the boat B from the position depicted in FIG. 1 to that depicted in FIG. 2 wherein the boat is generally above the anchor A. The movement of the boat can be effected by imparting a pulling force to the primary line L.

In order to release the anchor A from an ensnarement, it is necessary to transfer the pulling force from the primary line L to the release line 9 so that the anchor may be pulled backward out of its ensnarement. This is essentially accomplished by the coupling action of a coupling element indicated generally by the letter X and a release element depicted generally by the letter Y. More particularly release line 9 is secured to the crown end of anchor A by means of ring 10. Similarly release line 9 is secured to release element Y by means of ring 11. While release line 9 is normally manufactured of rope, if a heavy primary line L is utilized such as a chain, then wire rope or chain is used in connection with release line 9. Coupling element X is manipulated by means of lifting line 12 which is secured to manipulation element 13 by means of hook 14.

Figure 4:
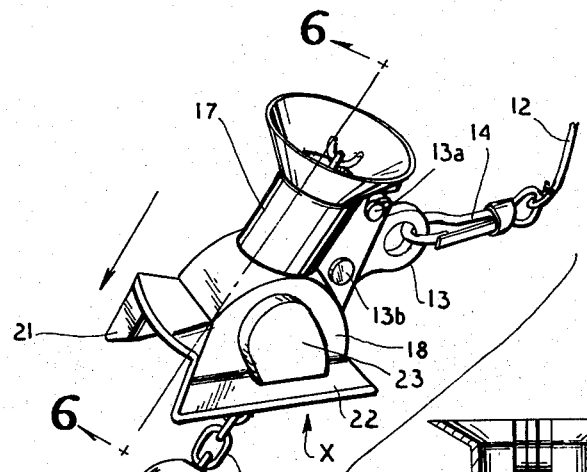
FIG. 4 is an enlarged perspective view of the anchor shown in FIG. 3 together with the coupling apparatus constructed according to this invention.
Figure 4:
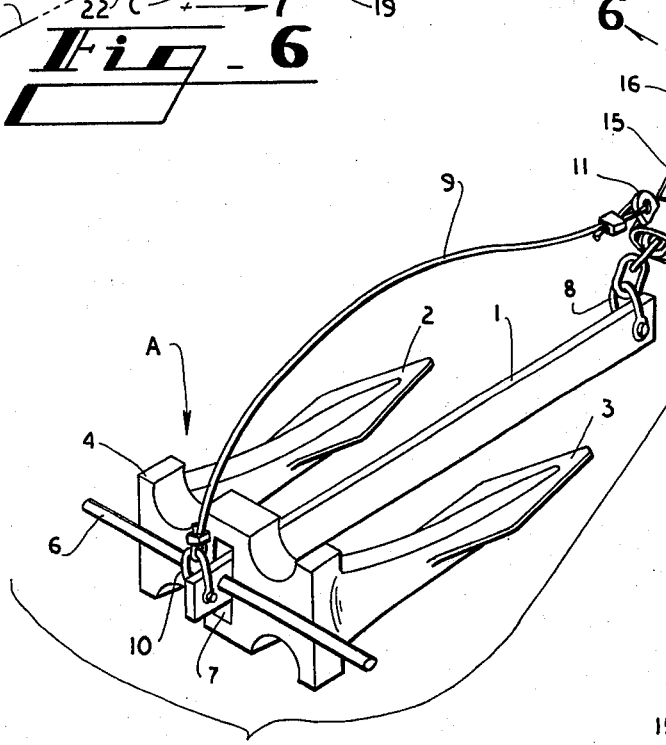

With reference to the coupling means which forms one facet of this invention, release element Y is slidably mounted on primary line L and comprises shank 15 and spherical portion 16. Coupling element X is slidable along primary line L and comprises a guiding cavity 17 and a coupling cavity 18. More particularly and as best shown in FIG. 6, coupling cavity 18 comprises an entry portion 19 and a locking portion 20. Also bevelled guides 21 and 22 are formed on the lower portion of coupling element X as viewed for example in FIGS. 4, 6 and 7. Disposed on each side of coupling element X are release element receiving slots 23 and 24. In order to render coupling element X easily slidably along primary line L and less prone to entanglement with primary line L, the upper portion of coupling element X is bevelled. In order to render coupling element X easily installable on primary line L, manipulation element 13 is detachably mounted on coupling element X by means of bolts 13a and 13b.

Therefore when an ensnared condition develops, the boat B is moved to the position depicted in FIG. 2 by simply exerting a pulling force on primary line L. Then coupling element X which is stored in boat B is installed on primary line L by removing manipulation element 13, placing coupling element X on primary line L, and then reattaching manipulation element 13. Following this, coupling element X is caused to slide downwardly in a direction along axis line C—C shown in FIG. 6 while the primary line L is held taut. This operation causes spherical portion 16 of release element Y to engage bevelled guides 21 and 22. Since bevelled guides 21 and 22 are spaced apart a distance less than the diameter of spherical portion 16 and are inclined to the axis of movement C—C, spherical portion 16 is caused to slide along bevelled guides 21 and 22 in a direction toward the right relative to coupling element X as shown in FIG. 6. Since the transverse dimension between release element receiving slots 23 and 24 is substantially equal to the diameter of spherical portion 16, spherical portion 16 enters entry portion 19 and in a continuous motion moves to locking portion 20. Following this primary line L is allowed to become slack and a pulling force is imparted to lifting line 12 in an upward direction along the line C′—C shown in FIG. 6. Spherical portion 16 is held firmly in locking portion 20 by a continuous pulling force exerted along line C′—C′ together with shoulders S formed in release element receiving slots 23 and 24.

Therefore a lifting force exerted on lifting line 12 causes coupling element X and release element Y to slide in unison upwardly along primary line L which in turn causes release line 9 to become taut. As the upward lifting force continues, a tension force is imparted directly to the crown end of anchor A and readily causes the flukes 2 and 3 to slide backwardly and upwardly into a disentangled condition. Thereafter the anchor A is hoisted into the boat B by means of the lifting line 12 and the primary line L.

Although this invention is depicted above in connection with a conventional anchor, it can be utilized with any type of anchor and also with grappling hooks. By this invention apparatus is provided by which especially large marine devices can be freed from an ensnared condition; and, since no moving parts are utilized, the apparatus is easily operable and not prone to mechanical breakdown. In addition the absence of moving parts allows the various elements of the apparatus to be cast in known manner without requiring intricate and costly machine work. Also no bulky parts are permanently attached to the anchor. Only the release element Y, which is slidably mounted on primary line L and connected to the crown of the anchor by the release line 9, is connected to the anchor.

The coupling element X is kept in the boat and is used only when the anchor becomes ensnared and cannot be easily lifted by conventional methods. One release element is needed for each anchor but only one coupling element is required per boat regardless of the number of anchors used per boat.

The embodiments of the invention in which an exclusive property or privilege is claimed are defined as follows:

1. Apparatus for retrieving an ensnared marine device having an elongated shank, a crown end disposed at one end of said shank, a ring end disposed at the other end of said shank and a primary line attached to said ring end and secured to the boat, said apparatus comprising a release element slidably mounted on said primary line adjacent said shank, a release line interconnecting said release element and said crown end for imparting a releasing force thereto, a coupling element slidable along said primary line for engaging said release element in coupled relation and comprising a guiding cavity for controlling the attitude of said coupling element during the sliding movement along said primary line and a coupling cavity, said coupling cavity comprising an entry portion for initially receiving a portion of said release element and a locking portion for preventing release of said coupled relation between said release element and said coupling element, and a lifting line connected to said coupling element.

2. Apparatus according to claim 1 wherein said lifting line is connected to said coupling element by means of a manipulation element.

3. Apparatus according to claim 1 wherein said guiding cavity is of an elongated configuration and is proportioned to the transverse dimension of said primary line so the proper attitude of said coupling element is maintained.

4. Apparatus according to claim 2 wherein said manipulation element is removably secured to said coupling element and spaced from the axis of said guiding cavity.

5. Apparatus according to claim 4 wherein said locking portion is disposed remote from said manipulation element.

6. Apparatus according to claim 3 wherein the center of said locking portion is disposed generally along the axis of said guiding cavity and wherein the center of said entry portion is spaced from said axis.

7. Apparatus according to claim 1 wherein said release element comprises a generally spherical portion for slidable engagement in said entry portion and said locking portion to form a coupled relation with said coupling element.

8. Apparatus according to claim 1 wherein said primary line comprises multiple chain links.

9. Apparatus according to claim 1 wherein said release line is interconnected with said crown end and wherein releasing force imparted thereto causes bodily movement of the marine device to cause release thereof.

* * * * *